United States Patent [19]

Hein et al.

[11] 4,168,653

[45] Sep. 25, 1979

[54] TWO POSITION VARIABLE DISPLACEMENT MOTOR

[75] Inventors: Allyn J. Hein, Camdenton, Mo.; Gerald D. Hall, Joliet, Ill.

[73] Assignee: Caterpillar Tractor Co., Peoria, Ill.

[21] Appl. No.: 752,578

[22] Filed: Dec. 20, 1976

[51] Int. Cl.[2] ..... F01B 3/02; F15B 15/24

[52] U.S. Cl. ..... 91/506; 91/486; 92/12.2; 92/13.7; 92/73; 92/129

[58] Field of Search ..... 91/506, 486; 92/12.2, 92/13.7, 73, 147, 71, 70, 13.1, 13.3, 129, 152; 417/222, 216, 269

[56] References Cited

U.S. PATENT DOCUMENTS

| | | | |
|---|---|---|---|
| 2,870,746 | 11/1954 | Keel | 91/172 X |
| 2,941,480 | 6/1960 | Sadler | 91/506 |
| 3,124,008 | 3/1964 | Firth | 91/506 |
| 3,183,844 | 5/1965 | Pitt | 92/12.2 |
| 3,234,889 | 2/1966 | Cooper | 92/12.2 |
| 3,312,146 | 4/1967 | Quéré | 92/152 |
| 3,429,225 | 2/1969 | Keyworth | 92/12.2 |
| 3,535,984 | 10/1970 | Anderson | 91/506 X |
| 3,682,047 | 8/1972 | Anderson | 91/505 |
| 3,733,970 | 5/1973 | Bosch | 91/506 |
| 3,830,594 | 8/1974 | Hein et al. | 417/270 |
| 3,921,503 | 11/1975 | Kubik | 91/506 |
| 3,958,496 | 5/1976 | Wallin | 91/506 |

FOREIGN PATENT DOCUMENTS

| | | | |
|---|---|---|---|
| 637040 | 10/1936 | Fed. Rep. of Germany | 92/12.2 |
| 2456944 | 6/1975 | Fed. Rep. of Germany | 91/506 |

*Primary Examiner*—Abraham Hershkovitz
*Attorney, Agent, or Firm*—Phillips, Moore, Weissenberger, Lempio & Majestic

[57] ABSTRACT

An axially oriented variable displacemnt pistoned device adaptable for use as motor and having a pivoted swash plate angularly positionable for establishing displacement of the device is fitted with externally mounted low pressure hydraulic actuators operably connected with the swash plate for operation thereof. Adjustable stops are provided in the device body to limit travel of the swash plate under urging of the low pressure hydraulic actuators.

6 Claims, 2 Drawing Figures

47
P
49
48
36
34
20
12
18
10
46
38
40
44
42
45
33
24
22
59
26
60
25
28
16
62
30
29
32
31
12
14
56
55
53
54
52
11
51

TWO POSITION VARIABLE DISPLACEMENT MOTOR

BACKGROUND OF THE INVENTION

Axially oriented pistoned variable displacement devices such as variable displacement motors are constructed with means for positioning the swash plate which determines displacement of the device. Such devices generally have a plurality of pistons reciprocably mounted in a circular arrangement of axially aligned cylinders in a cylinder block. The cylinder block is mounted for rotation on a drive shaft while each piston is operably connected to a pivotable swash plate angularly movable on an axis perpendicular to the drive shaft axis. Movement of the swash plate through such an angle varies the stroke length of the individual pistons as the cylinder block is rotated about the drive shaft axis. The swash plate, or a portion thereof, remains stationary relative to the drive shaft with the pistons and piston rods rotating with the cylinder block.

In such devices, the swash plate may be universally mounted about the drive shaft and fixed against rotation by interconnection with the device body. The mounting of the swash plate can include a pair of trunnions integrally formed with the swash plate and pivotally mounted in the device body. Positioning of the swash plate may be accomplished by a plurality of diametrically opposed and axially aligned actuating means in the form of hydraulic motors. The actuating means may be integrally formed with the device body and interconnected with the swash plate through the use of connecting rod means. The connecting rod means connecting the actuating means to the swash plate may be positioned outwardly of the cylinder axis a distance greater than the radius of the cylinder block in order to take advantage of the additional lever arm provided by such positioning, since the combination of hydraulic pressure and the lever arm must be sufficient to overcome the force acting against the actuating means by the pressure in the rotating cylinder block of the device itself. To utilize system pressure to position the swash plate requires a combination of greater effective cylinder area in the actuating means and/or lever arm as described above. However, by markedly increasing the cylinder area one can accomplish control of the swash plate positioning without utilization of a high pressure. To markedly increase the effective cylinder area requires either a larger device body or an "added on" actuating means.

SUMMARY OF THE INVENTION

The present invention is directed to overcoming one or more of the problems as set forth above.

Briefly stated, the invention is a swash plate actuator in a variable displacement hydraulic device. The variable displacement hydraulic device includes a housing and a swash plate for determining the displacement of the device. The swash plate actuator comprises a rocking beam member integrally formed with the swash plate and pivotally movable therewith. First and second push rod assemblies engage the rocking beam member on both sides of the pivot axis and extend outwardly therefrom. The push rod assemblies are generally parallel and slidably disposed in the housing. A first hydraulic actuator is mounted on the housing distal of the rocking beam member and cooperates with the first push rod assembly to rotate the rocking beam member in a first angular direction. A second hydraulic actuator is mounted on the housing distal of the rocking beam member and cooperates with the second push rod assembly to rotate the rocking beam member in a second angular direction. A first adjustable stop prevents rotation of the rocking beam member in a first direction beyond a preselected angle while a second stop prevents rotation of the rocking beam member in a second direction beyond a preselected angle. The first and second hydraulic actuators include first and second hydraulic cylinders affixed to the housing with first and second pistons slidably disposed therein. The first and second pistons are for abutting engagement with the first and second push rod assemblies while the first and second hydraulic cylinders each have a substantially greater cross sectional area than the push rod assemblies. A source of fluid pressure is provided to selectively supply fluid pressure to one or the other of the first or second hydraulic cylinders distal of the respective push rod.

DETAILED DESCRIPTION OF THE PREFERRED EMBODIMENT

Figures 1, 2:
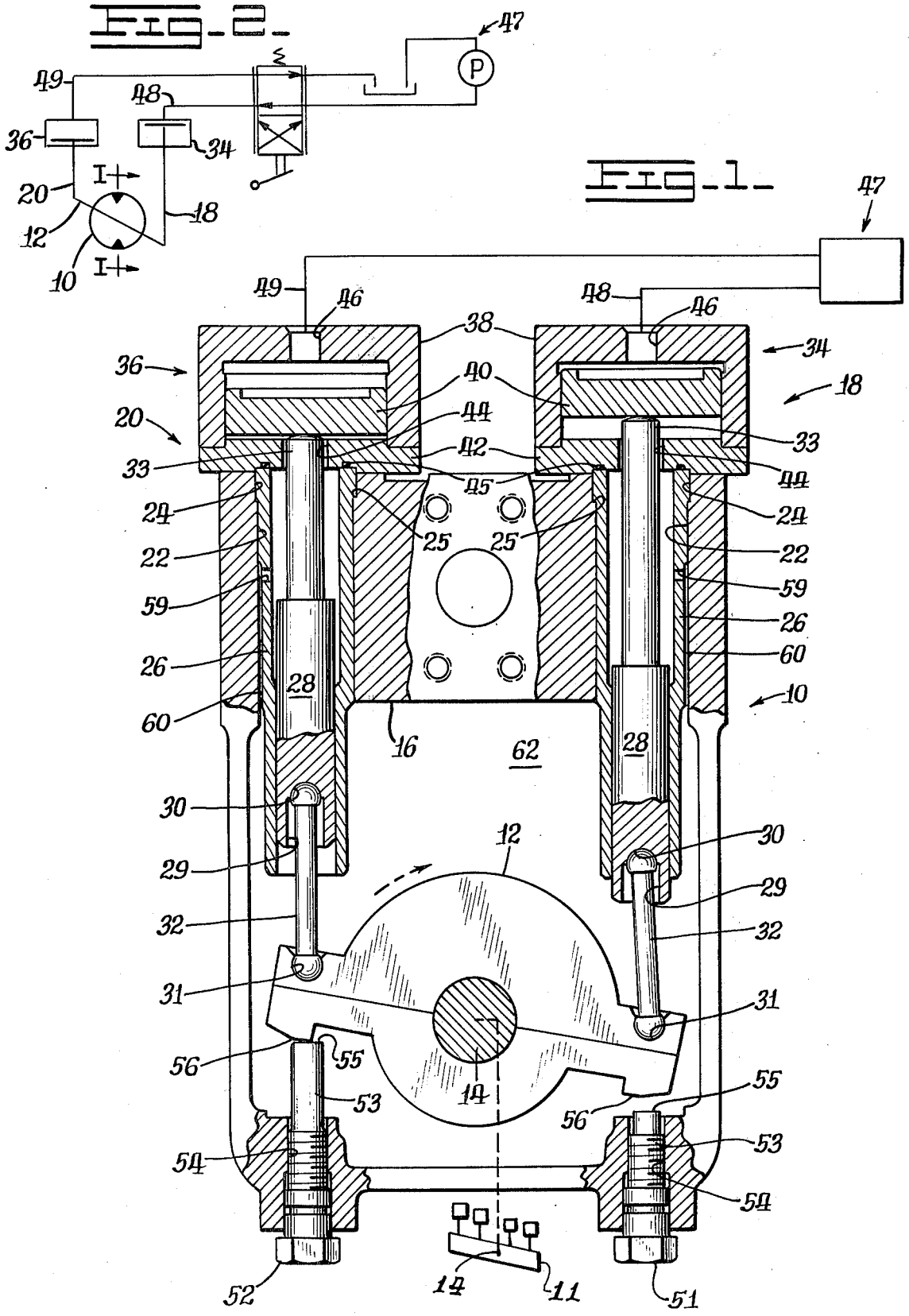
FIG. 1 partly in cross section and partly schematically shows the plurality of hydraulic actuating means which form the basis of this invention.
FIG. 2 schematically shows the hydraulic motor with the actuating means along with a control system.

This actuating means is described in the context of a two position variable displacement hydraulic motor. It is to be understood that the actuating means hereinafter described would be equally applicable in a two position or a multiple position hydraulic device operable as a pump or combination pump/motor with various changes in the control section which would be well-known in the art.

Shown in FIG. 1 is a view partly in section of a portion of a variable displacement hydraulic motor 10 also shown schematically in FIG. 2. Hydraulic motor 10 is of the axial piston variety wherein a plurality of pistons are disposed in a rotating cylinder block which drives the drive shaft. These details are not shown in FIG. 1 and do not constitute an essential portion of the invention. The displacement of the aforedescribed pistons resulting from reciprocation in the rotating cylinder block is determined by a swash plate 11 which may have integrally formed therewith a rocking beam 12. The swash plate may be pivotally affixed to housing 16 by a pivot 14 which may take the form of a trunnion. Rocking beam 12 is thus rotatable about pivot 14 and is represented schematically in FIG. 2 by the diagonal line crossing the circular symbol representing variable displacement motor 10. Housing 16 of hydraulic motor 10 has integrally formed therewith first and second push rod means 18 and 20 respectively. Since the first push rod means and the second push rod means differ in length only and are otherwise essentially identical, the description that follows relating to first push rod means 18 is equally applicable to second push rod means 20.

Parallel aligned bores 22 are formed in housing 16 normal to and laterally disposed outwardly from the axis of pivot 14. These bores would normally house cylinder-piston arrangements for positioning the swash plate; however, because of size limitations in the housing, the diameter of the cylinders is constrained thus a high pressure fluid is necessary for swash plate control. In certain applications where available high pressure fluid is insufficient for operation of hydraulic actuator means controlling the swash plate, it has been necessary to redesign the housing body to accommodate larger diameter cylinders to achieve swash plate control. By positioning the hydraulic actuator means exterior of the device body the size constraints are obviated. Push rod means may then be disposed in the bores to interconnect the exterior mounted hydraulic actuator means with the swash plate.

Each bore 22 defines a counterbore 24 at the end distal from rocking beam 12. The intersection of counterbore 24 with bore 22 forms a shoulder 25. A cylindrical sleeve 26 is disposed in bore 22 and counterbore 24. Sleeve 26 is formed with an enlarged end to abut shoulder 25. Disposed in cylindrical sleeve 26 is a reciprocally mounted actuator 28. The end of actuator 28 is formed with a bore 29 and a socket 30. Disposed between socket 30 and a similarly formed socket 31 in rocking beam 12 is a connecting rod 32. Each actuator 28 has extending outwardly of sleeve 26 and therefore housing 16 for a predetermined distance a rod 33.

Affixed to housing 16 are first and second hydraulic actuator means 34 and 36, each in the form of a cylinder/piston hydraulic motor. Hydraulic actuator means 34 and hydraulic actuator means 36 are also essentially identical and therefore only hydraulic actuator means 34 will be described. Hydraulic actuator means 34 is affixed to housing 16 by conventional means such as bolts (not shown) and is comprised of a cylinder 38 having disposed therein a piston 40. Cylinder 38 has affixed at the end proximate housing 16 a rod cap 42 transpierced by a bore 44 through which rod 33 of actuator 28 extends to engage piston 40. An annular seal 45 is disposed in a groove formed about bore 44 to sealingly associate rod cap 42 with housing 16. Cylinder 38 defines a bore 46 in the head end thereof through which hydraulic fluid may be communicated from a fluid pressure source 47 via conduits 48 and 49 leading respectively to first hydraulic actuator means 34 and second hydraulic actuator means 36. Fluid pressure source 47 is shown schematically in FIG. 2 and is representative only of a source of fluid pressure including a multi-positioned valve means for providing pressure alternatively to conduit 48 or 49 while venting the unpressurized conduit.

An important feature of this invention is the relative size of this first hydraulic actuator means 34, second hydraulic actuator means 36 and the first and second push rod means 18 and 20 respectively. In conventional variably displacement hydraulic devices, actuator means analogous to first push rod means 18 and second push rod means 20 are utilized alone for positioning rocking beam 12. In view of the small cross sectional area of the containing bore which would necessitate a high fluid pressure for swash plate control, the usual piston is replaced by actuator 28 and the hydraulic actuator means such as first hydraulic actuator means 34 having a much larger effective cross sectional area than is available in bore 22 without redesign of the housing. Utilization of the larger cross sectional area in first and second hydraulic actuator means 34 and 36 permits the use of lower hydraulic pressure such as the pressure found in pilot systems of conventional hydraulic devices.

Hydraulic motor 10 is herein described as a two position hydraulic motor, accordingly adjustable stop means 51 and 52 are associated respectively with first and second push rod means 18 and 20. Stop means 51 and stop means 52 are essentially identical differing only in the length of the particular stop member. A stop member 53 of predetermined length is threadably engaged in a bore 54 defined in housing 16 opposite bore 22. Stop member 53 is rotatable in bore 54 to position an anvil 55 at a preselected point. Rocking beam 12 is formed with a contact surface 56 generally opposite socket 31. Contact surface 56 is formed to engage anvil 55 when rocking beam 12 is rotated by first and second hydraulic actuator means 34 and 36 urging the first and second push rod means downwardly respectively.

In operation, fluid pressure is supplied to either conduit 48 or conduit 49 from control means 47, the other conduit being vented. Assuming fluid pressure is supplied to conduit 49, piston 40 is urged downwardly in cylinder 38 urging actuator 28 downwardly in sleeve 26. Simultaneously, connecting rod 32 translates this downward motion of actuator 28 to rocking beam 12 to rotate beam 12 in a counterclockwise direction, as shown in FIG. 1. The extent of rotation of rocking beam 12 is determined by the preselected length of stop member 53 of second adjustable stop means 52 and the length of rod 33. Fine adjustment of the limiting position of rocking beam 12 may be accomplished by rotation of stop member 53 in either the clockwise or counterclockwise direction. Relief of pressure in conduit 49 and supply of fluid pressure to conduit 48 rotates rocking beam 12 in a clockwise direction thus varying the displacement of the hydraulic motor 10, as depicted in FIG. 1 and FIG. 2. Although not specifically shown, variations in this invention could provide variable pressure at first and second hydraulic actuator means 34 and 36 to provide a continuum of positions for rocking beam 12 between the first and second adjustable stop means 51 and 52.

During operation, a certain amount of fluid may leak past piston 40 and drain downwardly of sleeve 26. Accordingly, sleeve 26 is formed with a drain port 59 and an axially oriented groove 60 so that excess fluid can be drained off sleeve 26 into the swash plate cavity 62 of the body of the hydraulic motor 10.

Although this invention has been described with particularity in relation to a two position variable displacement hydraulic motor, it is to be understood that modifications and variations within the skill of the art are possible and such modifications can include application to hydraulic pump means or other devices requiring at least two position control of a pivoted plate member in a housing.

What is claimed is:

1. In a variable displacement hydraulic device having a housing, a swash plate for determining the displacement of the device, a swash plate actuator means comprising:

a rocking beam member integrally formed with the swash plate and pivotally movable therewith;

first and second push rod assemblies, each having a first end distal of the rocking beam member and a second end engaging said rocking beam member on opposed sides of the pivot axis thereof and extending outwardly therefrom, said push rod assemblies generally parallel and slidably disposed in said housing;

first hydraulic actuator means mounted on and exteriorly of said housing, distal of said rocking beam member and cooperating with the first push rod assembly for rotating the rocking beam member in a first angular direction;

second hydraulic actuator means mounted on and exteriorly of said housing, distal of said rocking beam member and cooperating with the second push rod assembly for rotating the rocking beam member in a second angular direction;

first adjustable stop means for preventing rotation of the rocking beam member in the first direction beyond a preselected angle;

second stop means for preventing rotation of the rocking beam member in the second direction beyond a preselected angle;

said first and second hydraulic actuator means comprising first and second hydraulic cylinders affixed to the housing exteriorly thereof, and first and second pistons slidably disposed in said first and second hydraulic cylinders respectively, the first and second pistons being unsecured to and in abutment engagement with the first end of the first and second push rod assemblies respectively, the first and second hydraulic cylinders each having a substantially greater cross-sectional area than the push rod assemblies; and a source of fluid pressure for selectively supplying fluid pressure to one or the other of the first or second hydraulic cylinders distal of the respective push rod assembly.

2. The swash plate adjusting means set forth in claim 1 wherein the housing defines first and second parallel cylinders, the cylinders having respectively disposed therein the first and second push rod assembly means.

3. In an axial piston variable displacement hydraulic device including a device body and a pivoted swash plate having an integrally formed rocking beam extending outwardly therefrom; a swash plate adjusting means comprising:

first and second fluid pressure positioning means disposed at opposed ends of the rocking beam for angularly positioning said beam;

each fluid pressure positioning means comprising a small area cylinder formed in the device body, an actuator rod slideably disposed in the small area cylinder and having a first end distal of the rocking beam and a second end, a connecting rod connecting the actuator rod second end with the rocking beam and a separate large area cylinder axially disposed distal of the rocking beam and affixed exteriorly of the device body, the actuator rod first end extending inwardly of the large area cylinder, and a large area piston reciprocally disposed in each large area cylinder, the large area piston being unsecured to and in abutting engagement with the first end of the respective actuator rod; and, a source of fluid pressure for selectively supplying fluid pressure to one or the other of the first or second large area cylinders distal of the actuator rod.

4. The combination set forth in claim 3 further comprising first and second adjustable stop means for limiting pivoted movement of the rocking beam.

5. The combination set forth in claim 4 wherein the device body defines parallel bores extending through the body from points generally coincident with the opposed ends of the rocking beam said bores perpendicular to and displaced laterally from the pivot axis of the swash plate; and, further wherein the small area cylinders formed in the device body include the parallel bores and further comprise axially bored sleeve members formed to fit said parallel bores and each to slidably receive said actuator rod.

6. The combination set forth in claim 5 wherein the device body further defines an internal swash plate cavity encompassing the swash plate and integrally formed rocking beam, and further wherein the parallel bores communicate with said swash plate cavity; and, wherein each sleeve member further defines a radial bore and an axial groove on the exterior of the sleeve member, said radial bore and the axial groove communicating the axial bore of the sleeve member with the swash plate cavity.

* * * * *